United States Patent [19]

Goldhammer

[11] 4,355,575

[45] Oct. 26, 1982

[54] PRESS PLATE DRIVE FOR A BALING PRESS

[76] Inventor: Albert Goldhammer, Zum Hecht 46, 7770 Überlingen, Fed. Rep. of Germany

[21] Appl. No.: 196,177

[22] Filed: Oct. 14, 1980

[30] Foreign Application Priority Data

Oct. 18, 1979 [DE] Fed. Rep. of Germany ..... 2942227
Oct. 18, 1979 [DE] Fed. Rep. of Germany ..... 2942239

[51] Int. Cl.[3] ..... B30B 1/18

[52] U.S. Cl. ..... 100/245; 100/289; 100/295

[58] Field of Search ..... 100/245, 289, 295, 53, 100/48, 256

[56] References Cited

U.S. PATENT DOCUMENTS

| | | | |
|---|---|---|---|
| 3,024,720 | 3/1962 | Welsh | 100/245 X |
| 3,079,856 | 3/1963 | Swartz | 100/256 |
| 3,762,312 | 10/1973 | Guhl | 100/53 |
| 3,827,350 | 8/1974 | Gilman | 100/53 |
| 3,831,513 | 8/1974 | Tashman | 100/289 |
| 3,855,919 | 12/1974 | Potter | 100/53 |
| 3,867,880 | 2/1975 | Bourgeois | 100/289 |
| 3,921,515 | 11/1975 | Eckerle | 100/289 X |

FOREIGN PATENT DOCUMENTS

| | | | |
|---|---|---|---|
| 2356517 | 5/1975 | Fed. Rep. of Germany | 100/289 |
| 1405181 | 7/1975 | United Kingdom | 100/53 |

*Primary Examiner*—Billy J. Wilhite
*Attorney, Agent, or Firm*—Parmelee, Miller, Welsh & Kratz

[57] ABSTRACT

A motor driven drive is provided for a press in the nature of a baling press which translates rotary motion into reciprocating pressing motion of a pressing plate. The translation of motion is through a drive system which is flexible and adjustably connected to the drive of the plate to assure minimized frictional operation of the plate by reason of a rotary and tilting type of drive screw mechanism. Electrical switch means is provided for controlling the actuation of the plate in accordance with the development of the bale which is being pressed.

6 Claims, 4 Drawing Figures

PRESS PLATE DRIVE FOR A BALING PRESS

This invention relates to a press plate drive in a baling press or similar machine, having a press plate driven by an electric motor via a gear movable longitudinally in a press and control of the press plate drive and other press functions.

The object of the invention is to develop a press plate drive of the above mentioned type such that a smaller driving output compared to the press output is obtained at a lower manufacturing cost and noise generation during driving is substantially obviated. A further object is the control of the press plate drive and other press functions.

In order to fulfill this object, the invention is characterized in that on the press plate a longitudinally movable spindle is fixed, the outer screw thread of which engages in the inner screw thread of a spindle nut which is rotated by means of an electric motor the said spindle nut being mounted on a self adjusting double universal joint on the housing of the press.

A feature of the present invention is that with a substantially smaller drive output than in previous hydraulic presses an equally large press output may be achieved, for example, with a drive output of 1.5 kw a press output of 6 tons is obtained whereas usually a drive output of about 2.2 kw would be required. The reason for the reduced drive output with press output remaining the same and for a cheaper construction of the press is that the spindle nut can be adjusted automatically in respect to the press plate.

Moreover a substantially noiseless press driving is obtained as tiltings of the press plate no longer have to be compensated by an increased drive output but are taken up by the self-adjusting spindle nut. It is preferable that the spindle nut be mounted as a double universal joint on the housing. This means that the spindle nut is mounted in the housing adjustable in all three planes. In less efficient embodiments of the present invention it would suffice to mount the spindle nuts adjustable only in two planes.

There are various methods of mounting the spindle nut in the housing so that it is self adjusting. In a preferred embodiment of the present invention the spindle nut is mounted in a pressure housing via two roller bearings placed towards one another in respect to the driving direction and the pressure housing is mounted and rotatable in a frame which in its turn is mounted pivotably in the housing in perpendicular plane to the axis of rotation of the pressure housing. By the use of roller bearings tilted towards one another the press forces transmitted in axial direction from the spindle to the spindle nut are transmitted to the pressure housing. Instead of the use of roller bearings tilted towards one another barrel bearings or other known bearings may be used as long as the force is transmitted in axial direction.

A further feature of the present invention is that the pressure housing (bearing housing) is taken rotatably in a frame.

The axis of rotation is selected so that it lies in a vertical plane. This means that the horizontal tiltings (pivoting movements of the press plate in horizontal plane) are transmitted via roller bearings to the pressure housing and that when the pressure housing is rotated in respect of the frame the tilting forces are rendered harmless.

If the axis of rotation is disposed between the pressure housing and the frame in a horizontal plane then tiltings of the press plate are taken up in a vertical plane. The preferred rotatable bearing for the pressure housing is a screw to be screwed into a screw thread bore of the frame, the said screw engaging a pin (having a pin end of reduced diameter) in an associated bore of the pressure housing. In this way the desired rotary bearing is obtained with the pin in conjuction with the associated bore.

In the perpendicular plane to the axis of rotation mentioned above, a second pivot bearing between the frame and the housing of the press is provided. Similarly a pin bore bearing could be provided here. It is, however, preferred that for the pivotable bearing of the frame in the housing of the press, adjusting screws be provided. Thus, in a simple manner manufacturing weaknesses which may result from welding together of the different parts, can be compensated by the adjusting screws being suitably adjusted.

In the present invention it is essential that the spindle nut is mounted in the housing with two axes of rotation perpendicular to one another so that it can take up and compensate the tiltings of the press plate without any additional friction which would increase the driving output required.

In order to guide the press plate as it moves longitudinally in the housing, it is preferable that a tilting of the press plate to the housing of the axis of rotation between the pressure housing and frame is provided. There are guide elements attached to the press plate in the direction of displacement which are guided along in the casing U-shaped profiled guide grooves formed by guide bars. The press plate is thus allowed a certain bearing clearance in its longitudinal guide and this clearance is taken up by the self adjusting spindle nut without any additional friction losses occurring. The electric drive of the spindle nut can thus be of small dimensions and this reduces substantially the space requirement and the costs of the press. The spindle is rotated by means of a toothed wheel connected to the spindle nut, the said tooth wheel being driven via a chain from a driving pinion flanged on a gear driven shaft.

The shaft is actuated by transmission gearing, so that the spindle nut is driven around relatively rapidly. The screw thread for the spindle nut and the associated spindle is preferably a double trapezoidal thread TR $50 \times 16$ as this allows particularly low noise running.

With horizontally driven bale presses the material to be pressed in the form of bales is first loaded into the bottom of the press. Therefore the lower part of the press plate always experiences a stronger counter force than the upper part of the press plate. In order to avoid possible resulting tiltings of the press plate, the spindle is arranged to engage off center on the press plate, that is, the engaging point lies on the middle longitudinal axis but lower than the middle crosswise axis of the press plate, in order to compensate for irregular loading of the press plate and substantially reduce any tendency of the press plate to tilt.

To achieve the object of improved control of the press plate drive and other press functions, the invention is characterized in that the press plate is guided in a housing and that a switch disposed in the guide track is directly operated by the press plate.

The main feature of the present invention is the direct operation of the switch by the movement of the press plate. This is achieved by disposing a switch in the guide track of the housing. The switch, itself, is not disposed directly in the guide track because it would not then be protected from dirt inside the press housing. According to the invention operation of the switch is effected by the press plate by means of an operating cam projecting into the guidetrack of the press plate, the said cam being connected to the free resilient end of a spring band or strap which is attached to the housing and also bears against the switch cam of the switch. Thus the switch is disposed outside the press housing and is protected from dirt and damage. Reliable operation of the switch is achieved without a set of operating rods, which may often need repairing being inserted between the switch and the press plate.

In order to protect the switch from dirt, damage or interference of any kind, it is disposed outside the housing and closed in by a covering wall over the side wall of the housing.

Direct operation of the switch by the press plate and its arrangement outside the housing but inside a covering will ensure a particularly reliable control which is not liable to breakdown. The control is mainly for the press plate drive, and operates such that upon reaching the maximum allowable length of bale the switch stops the press drive so that the operator can no longer load material. The switch may also bring into operation a control light which indicates to the operator that the maximum permissible bale length has been reached and the bale is now to be bound and removed from the press.

The switch may also be used for a fully automatic operation of the bale press.

In detail the control proceeds as follows:

In the operation of the press in the making of a bale the material lying in front of the press plate is loaded in the housing via a filler opening. The press plate moves as before and compresses the material against the press front wall. The forward driving of the press plate is controlled by a time switch member which is started by the switching on of the press drive and the forward motion of the press plate. The bale is held for some time in its front end position and then the press plate runs back again and remains controlled by the time switch member.

The holding of the previously made bale is however effective only when sufficient material is present, that is sufficient counter pressure, otherwise immediately after reaching its front end position the press plate runs back and remains there so that the press procedure is substantially shortened. When the press plate has arrived at its rear resting position (equivalent to its initial position), the operator must press a knob so that the press procedure is started again.

Before starting a new press procedure, the operator loads the material via a filler opening, closes the door or flap of the filler opening and effects the other safety arrangements. From the foregoing description it follows that with each further loading and pressing the resulting bale at the press wall becomes longer and thus shortens the path of movement of the press plate. Since the time switch has a constant time adjustment, but the pressing path decreases with increasing material compression and length of bale, the press piston always remains longer at the front on the already pressed piece of bale so that excellent uniform bale pressing is achieved.

In one embodiment of the present invention a proposed switch is provided for switching off the press drive upon reaching the maximum length of bale. To achieve this, guide elements are provided pointing laterally on the press plate in longitudinal direction (that is, in the direction of displacement) which run in corresponding guide tracks on the housing.

The guide elements actuate the switch or several switches and to accomplish this it is preferred if the parts of the guide elements lying forward in the direction of displacement are wedge shaped. The wedge shaped tips of the operating cam then actuate the switch. The actual position of the switch in the press housing and the length of the guide elements is selected such that upon reaching the maximum pressable bale length, the switch remains actuated to an open position by the guide elements of the press plate. A secure switch is proposed so that contact failures can no longer cause the press drive to be inadvertently switched on.

In the following the invention is explained more precisely with reference to the drawings illustrating one embodiment of the invention.

Figure 2:
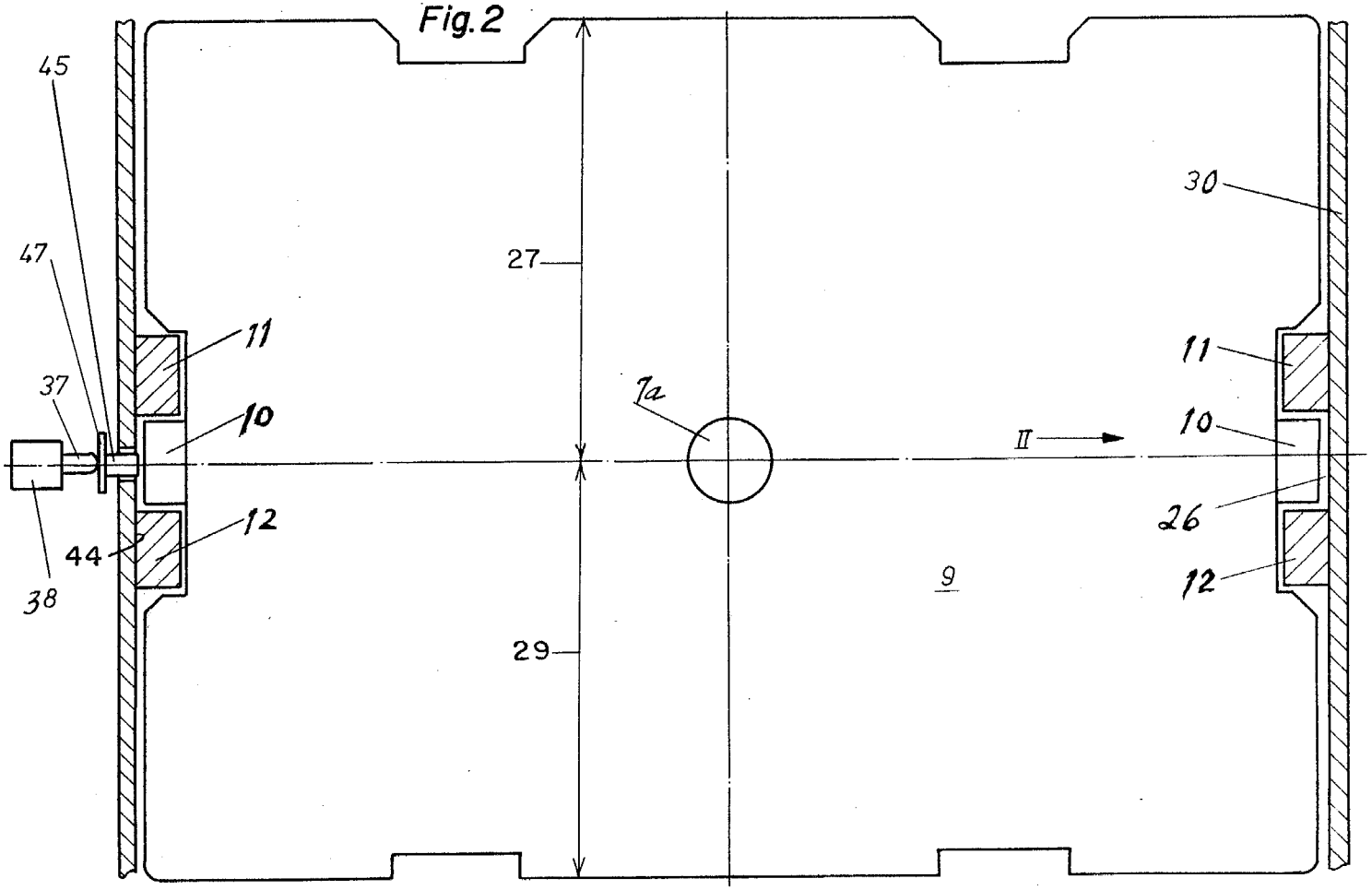
FIG. 2 is a vertical cross section through the housing of the baling press with a front view of the press plate but without representation of the lateral covering wall of the housing and other parts not required for the description.
Figure 4:
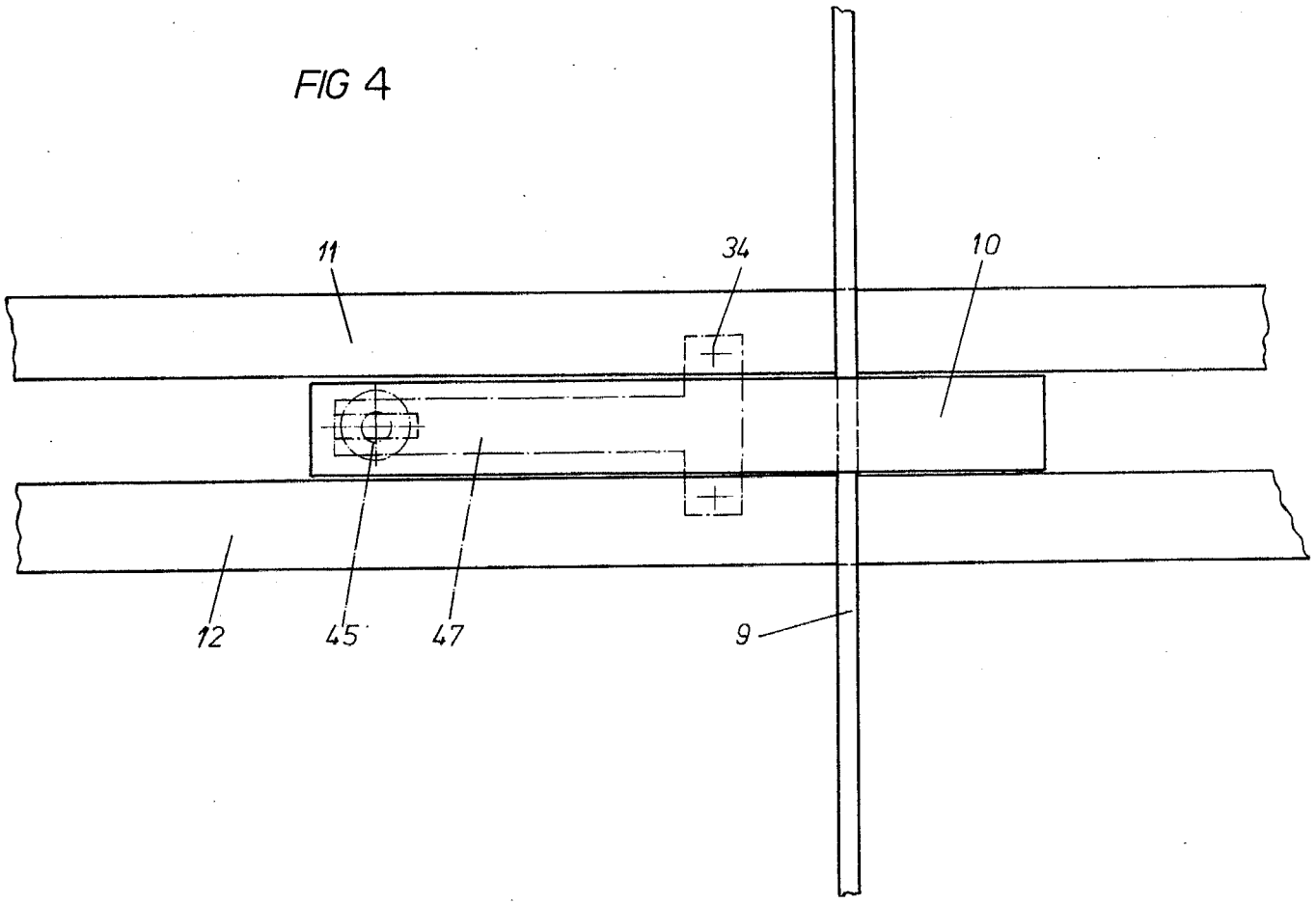

And, FIG. 4 is a plan view taken in the direction of the arrow II in FIG. 2 of the longitudinal guide of the press plate on the press housing.

An electric motor 1 with a gear unit 2 is flange-fitted on a motor housing 30*a*. The drive shaft of the gear unit 2 is connected to a driving pinion 3, and placed thereover (meshing therewith) is a chain 4 which also runs over (meshes with) a toothed wheel 5 which is rotationally attached to a spindle nut or sleeve 6. The spindle nut 6 has a double inner trapezoidal screw and is located on the associated screw thread of a spindle 7 movable in the direction of the arrows 8 and 8' on a reduced diameter front end 7*a* of which a press plate 9 and its hub 33 are fixed for longitudinal movement therewith.

Figure 1:
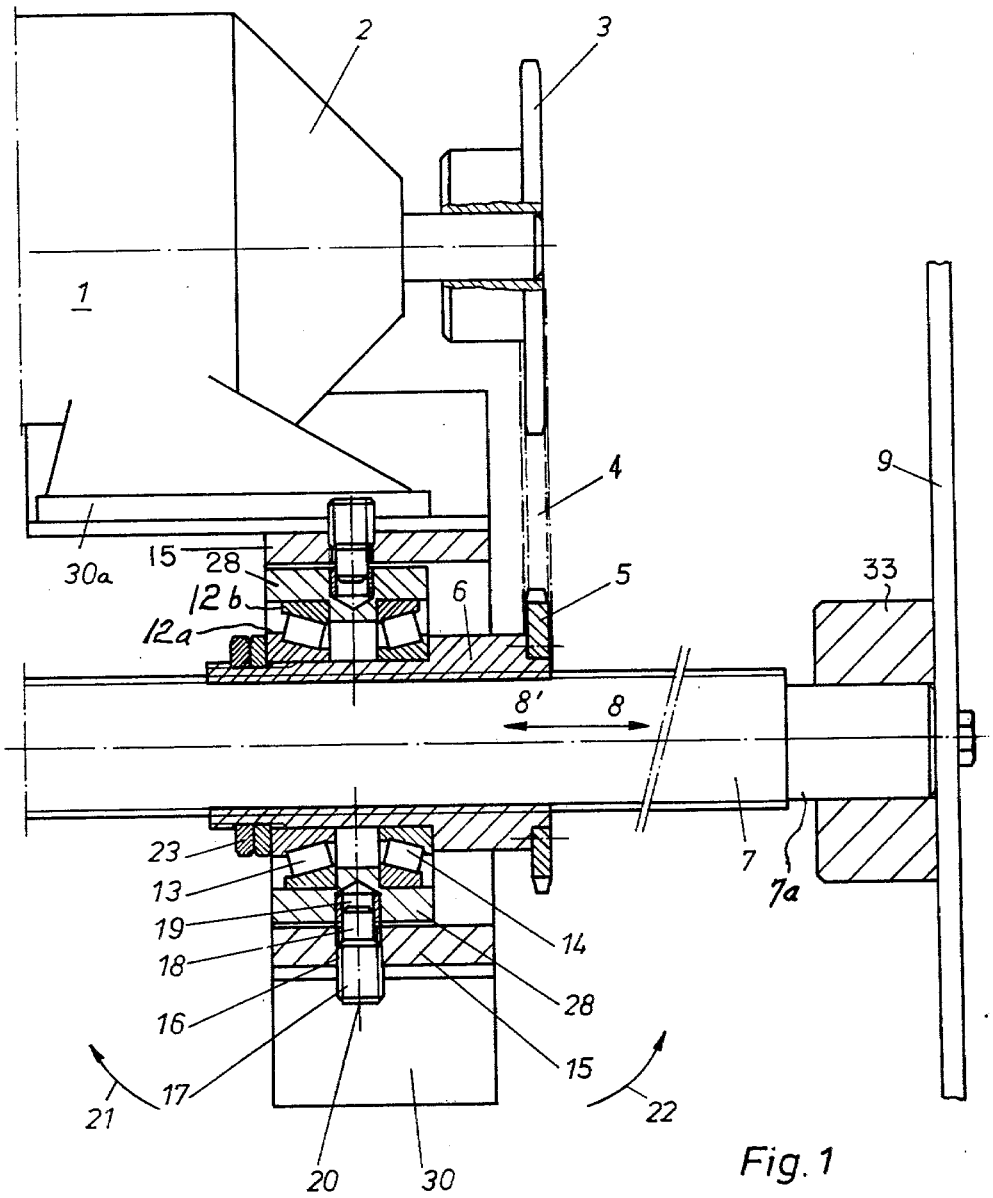
FIG. 1 shows diagrammatically a middle longitudinal section through the press drive according to the invention.

The spindle nut 6 is adjustable (self-adjustable) in two planes perpendicular to one another in that on its outer periphery, two mutually adjustable roller bearing assemblies 13 and 14 are positioned by mutually counter-screw threaded nuts 23. The nuts 23 may be used with washers or shims (not shown) to provide a suitable adjusted positioning of the bearing assemblies 13 and 14 with respect to the spindle sleeve or nut 6. The roller bearings 13 and 14 take up the axial forces of the spindle 7 acting in the direction of the arrow 8. An outer fixed bearing ring 12*b* of the roller bearings 13 and 14 is positioned in a pressure housing 28 which is arranged rotatably (see pivot 20) with respect to a frame 15. Inner bearing ring 12*a* is carried with a recess in the nut 6 (see FIG. 1).

The rotary mounting is effected by having in the frame 15 a screw threaded bore 16 in which a screw 17 is screwed. The front end of the screw 17 has a reduced diameter pin 18 which engages in a bearing sleeve lined bore 19 of the pressure housing 28. By the engagement of the pin 18 in the bore 19, a rotary bearing is formed by the pivot 20. The frame 15, in turn, is mounted pivotably in the motor housing 30 in a perpendicular plane to the pivot 20 for movement in the directions of the arrows 21 and 22 of FIG. 1.

The bearing is effected by adjusting screws which render possible a pivoting of the frame 15 in the curvilinear swing directions of the arrows 21 and 22. In this way manufacturing weaknesses which are produced by the welding together parts of the frame and other inaccuracies of the parts are compensated.

Figure 3:
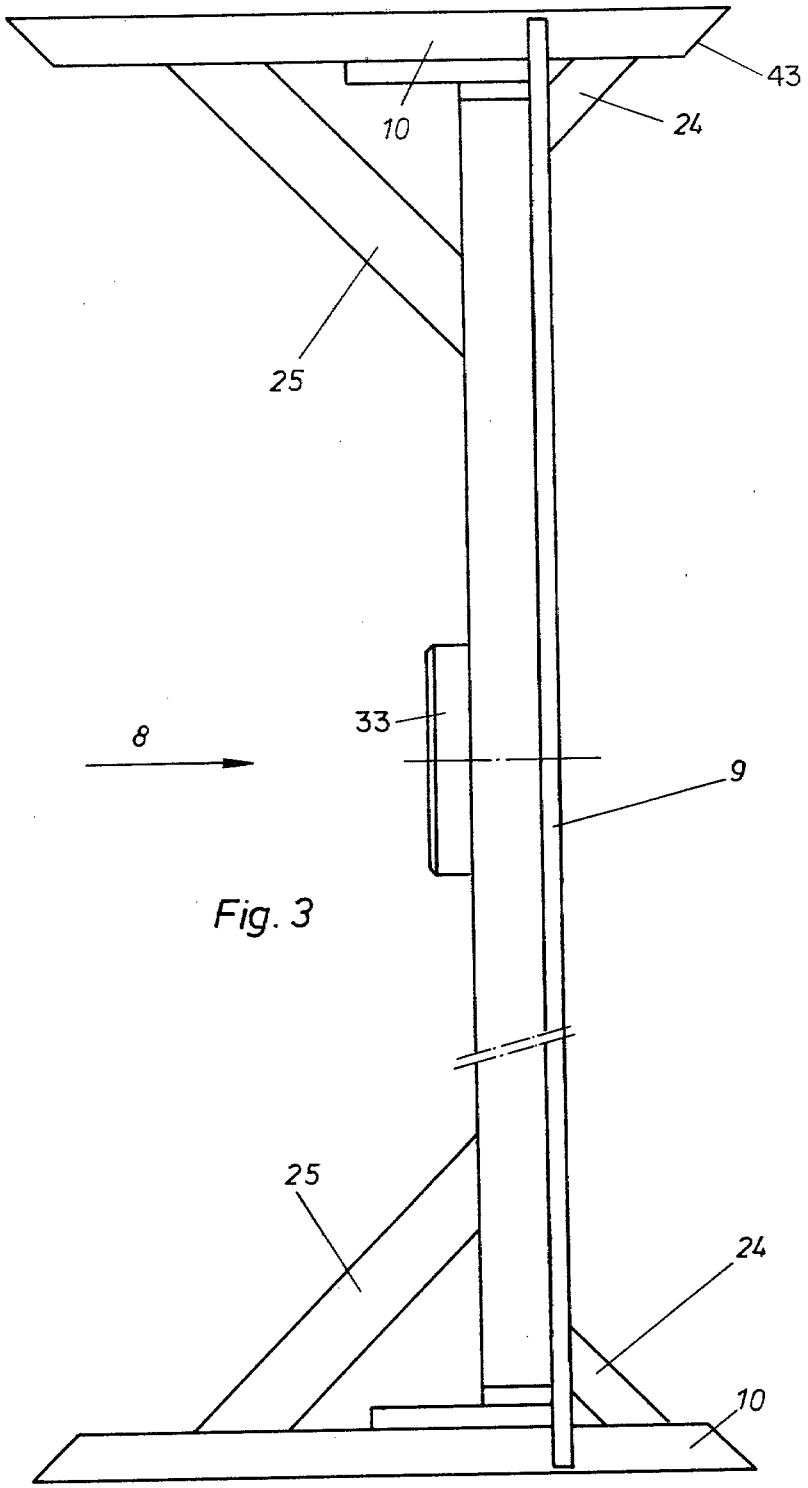
FIG. 3 is a plan view of the press plate.

According to FIG. 2, the press plate 9 is mounted in the side wall of the housing 30 for longitudinal back and forth movement as effected by the spindle 7. On the press plate 9 are disposed a pair of guide rail elements 10 which point in longitudinal direction and which are supported by angled cross pieces 24 and 25 on opposite sides of the press plate 9 (see FIG. 3). On the side wall of the housing 30 are disposed guide rods or strips 11 and 12 which form a U-shaped groove 26 open sideways and provide a guide track 44 for the guide rails 10. By guiding the press plate 9 on the housing 30 in this manner the press plate is allowed a slight tilting with a pivot which runs through the pivot 20 of the screw 17. In this way, low frictional running of the press plate 9 is achieved.

In order to avoid a tilting of the press plate 9 in a vertical longitudinal middle plane due to the fact that more material is to be compressed on the bottom of the press housing than on the upper side, the spindle or sleeve 7, according to FIG. 2, engages on the press plate 9, at a point displaced a little downwards from the center so that the distance 27 is greater than the distance 29. The described conditions vary correspondingly when a press drive other than a horizontally movable one is used.

A self adjusting spindle nut 6 is provided which compensates the tilting of the press plate 9, and thus avoids excessive friction losses, so that a drive of substantially smaller dimension and lower noise than usual can be used. The use of a mechanical spindle drive reduces by approximately two thirds the costs of a hydraulic drive.

According to FIG. 2, the operation of an electric "off" and "on" switch 38 disposed outside the housing 30 is effected, in that on the bottom of the U shaped guide track 44, a recess for the passage of an actuating cam 45 is provided.

This actuating cam 45, is according to FIGS. 2 and 4, fixed on the free resilient end of a spring strap or band 47 which is formed as a banding spring clamped on one side. The spring band 47 is attached to the housing 30 by means of fastenings 34. According to FIG. 4, the switch cam 37 of the switch 38 is located on the outside of the spring band 47. With every advance of the press plate 9 in the direction of the arrow 8 of FIG. 3, the wedge-shaped point 43 of the guide element 10 of the press plate 9 runs over the operating cam 45 of FIG. 2 and presses this outwards from the housing so that at the same time switch cam 37 of the switch 38 is actuated.

When the maximum length of the bale has reached the end of the guide element 10 lying further behind the direction of advance, the cam 45 no longer runs over the switch 38, so that the switch remains continuously actuated (closed). When in this position, the previously mentioned switch 38 stops (opens), that is, when a certain time is exceeded, these two positions are defined as the time of the presence of the maximum bale length. When both conditions are fulfilled, the press drive is stopped and the switch provided for starting the press drive will not work. In the preferred embodiment shown, switch 38 is actuated mechanically by the press plate 9. Instead of the mechanically actuated switch 38 contactless switches such as inductively, capacitively or magnetically operated switches may be used.

It is only essential that the switches are actuated directly from the press plate 9 without a set of operating rods being inserted between the switch and its switch cam. It is also essential that the switch is disposed outside the housing, but inside a covering wall, so that it is protected from dirt, and damage or interference of any kind.

I claim:

1. A pressing plate drive construction for a baling press or the like which comprises, a housing, a pressing plate operatively mounted in a guided track means within the housing for longitudinal advancing movement therewithin, a longitudinally extending operating spindle carrying said plate on a front end thereof, bearing means carrying said spindle in an axially forwardly movable relation within the housing, said spindle having a threading therealong, a spindle sleeve having a cooperating inner threading to operatively mount it on said spindle shaft, rotatable motor means mounted on the housing, driving connections between said motor means and said spindle sleeve for rotating said sleeve to move said spindle shaft longitudinally within said housing, universal bearing means positioned between said housing and said spindle sleeve for taking up axial and radial thrust exerted by said spindle shaft on said spindle sleeve, said bearing means having a group of axially opposed sets of roller bearings, a pressure housing carried by said housing to support said roller bearings, and said roller bearings being mounted in an axially inclined relation between said spindle sleeve and said pressure housing.

2. A pressing plate drive construction as defined in claim 1 wherein, said bearing means has pin means pivotally mounting said bearing means with respect to said housing and perpendicularly with respect to said spindle shaft.

3. A pressing plate drive construction as defined in claim 1 wherein, said bearing means has an outer bearing ring carried by said pressure housing and an inner bearing ring carried by said spindle sleeve, and said bearing rings have surfaces that incline from their opposite sides centrally inwardly and in a complementary roller bearing-receiving relation with respect to each other.

4. A pressing plate drive construction as defined in claim 3 wherein oppositely positioned central pivot pins operatively carry said outer bearing ring with respect to said first mentioned housing.

5. A pressing plate drive construction as defined in claim 1 wherein, said bearing means has an outer bearing ring and an inner bearing ring carrying said roller bearings therebetween, said pressure housing is positioned about and carries said outer ring, a frame is interposed between said pressure housing and said first-mentioned housing, and pivot means extends perpendicularly with respect to said spindle shaft and between said frame and said pressure housing to pivotally carry said outer ring with respect to said frame.

6. A pressing plate drive construction as defined in claim 5 wherein said pivot means threadably adjustably extends from said frame into said pressure housing.

* * * * *